US005461809A

United States Patent [19]

Fowler et al.

[11] Patent Number: 5,461,809

[45] Date of Patent: Oct. 31, 1995

[54] DUAL CAM MOUNTING MECHANISM FOR ELECTRONIC SHELF EDGE LABELS

[75] Inventors: Roger G. Fowler, Apex; Richard H. Harris, Raleigh, both of N.C.

[73] Assignee: International Business Machines Corporation, Armonk, N.Y.

[21] Appl. No.: 284,335

[22] Filed: Aug. 2, 1994

[51] Int. Cl.[6] ..... G09F 3/18

[52] U.S. Cl. ..... 40/642; 40/662

[58] Field of Search ..... 40/642, 662; 248/231.3, 248/222.1, 223.4, 225.1

[56] References Cited

U.S. PATENT DOCUMENTS 4,357,768 11/1982 De Dube ..... 40/653
4,805,331 2/1989 Boggess et al. ..... 40/651
4,909,464 3/1990 Levine et al. ..... 40/649 X
4,939,861 7/1990 Soublière ..... 40/651

*Primary Examiner*—Kenneth J. Dorner
*Assistant Examiner*—James O. Hansen
*Attorney, Agent, or Firm*—Joscelyn G. Cockburn

[57] ABSTRACT

A product information module (such as a shelf tag, shelf label or the like) includes a housing in which a physical embodiment of information is mounted and a locking device which mounts the housing to a support surface. The locking device includes a locking member which coacts with the support surface to form an angle A whose tangent is less than the coefficient of friction between the locking member and the support surface. As a consequence, locking force is minimal and lateral movement of the module is resisted no matter how much force is applied.

18 Claims, 3 Drawing Sheets

DUAL CAM MOUNTING MECHANISM FOR ELECTRONIC SHELF EDGE LABELS

BACKGROUND OF THE INVENTION

1. Field of the Invention

The invention relates to advertising display modules in general and, in particular, to such modules and devices used to mount them to shelves in a grocery store or other retail establishment.

2. Prior Art

The use of electronic shelf labels, in grocery stores or other establishments, to provide pricing and other information to customers is well-known in the prior art. For a typical grocery store or other retail establishment, the merchandize or goods are arranged in separate groups on shelves. Each shelf has a flat surface on which the goods are placed and a channel attached to its distal edge. The shelf labels which carry information such as pricing, etc., are positioned in the channel. The number of shelf labels in a channel depends on the different groups of goods which are placed on a particular shelf. Since multiple shelf labels can be inserted in the same shelf channel, the shelf label once inserted must not slide relative to the products with which it is associated. If sliding were to be permitted, the shelf label could be associated with a different group of products and mislead the shopper. Consequently, a reliable locking mechanism is required to anchor the shelf label to the shelf channel.

Shelf channels are typically formed of extruded metal sections such as an extruded aluminum section. The metal sections often vary in width and, as a result, each store could have different shelf channel sizes all of which have to be fitted with appropriate shelf labels. To meet this requirement, shelf label manufacturers often provide many different types of mounting mechanisms. Even with a wide assortment of mounting mechanisms, it is frequently necessary to install new extruded metal sections (channels) before the labels can be installed. In addition, the cost of new channel extrusions and the multiplicity of mounting mechanisms are very expensive. Therefore, it is desirable to have a single mounting mechanism which fits a wide variety of shelf channels. In a typical arrangement, the shelf channel ranges from a minimum width of 1.05 inches to a maximum of 1.25 inches.

Other desirable characteristics for the shelf label with mounting mechanism are access for installation and removal of the label should be from the top or bottom, cost of the mounting mechanism should be relatively low (say no more than $0.25 per label), installation should not require a tool, removal should require a tool, the tool or label should not scratch or damage the shelf label channel and forces, caused by the mounting mechanism, which tend to expand the shelf label channel should be kept to a minimum.

Informational modules and mounting mechanisms have been used in the prior art. Examples of prior art devices are set forth in U.S. Pat. No. 4,939,861, issued on Jul. 10, 1990 to marc P. Sowbliere, U.S. Pat. No. 5,044,104, issued on Sep. 3, 1991 to Siegfried Hoperdietzel and U.S. Pat. No. 5,289,652 issued on Mar. 1, 1994 to George Kringel et al. Even though the prior art devices may work well for their respective environments, none provide all of the above described desirable characteristics and all are plagued with one or more of the above identified problems.

SUMMARY OF THE INVENTION

It is the main object of the present invention to provide a more efficient shelf label module and mounting mechanism than was heretofore possible.

It is another object of the present invention to provide a shelf label module which does not slide in the shelf channel, is easy to mount and very difficult to remove without the use of a special removal tool.

It is yet another object of the present invention to provide a mounting mechanism which fits a multiplicity of different size shelf channels.

These and other objects are met by a shelf label module having a housing which supports an electronic display device or paper sheet and a locking device. The electronic display device or paper sheet carries information about products and the locking device mounts and locks the module in the shelf channel. The locking device is such that, if it is in the unlocked position, it can easily be positioned within the channel. If the locking device is placed in the locking position, an angle of repose is maintained over a wide range of channel widths and only a small force is applied to the channel by the locking device. As a consequence, the module is secure and does not slide in the channel no matter how much force is applied.

In particular, the locking mechanism includes two sheet metal cams, a wire spring and two rivets. The cams are rotatably mounted, in spaced relation, by the rivets to the housing. Each cam is provided with a through hole in which the free ends of a looped wire spring is inserted. The wire spring provides a torque to each cam and keeps them in a home position (non-contact with shelf channel). This position is also called "under center position" of the cams. In this position the module is inserted easily in the channel. If a force is applied against the spring, moving it in a first direction, the cams rotate in opposite directions until the edges of each cam are brought into contact with the channel to lock the module in the channel. The module can be removed easily by applying a force, opposite to the first direction, to the spring.

In an alternate embodiment, vein-like protrusions are fabricated on the surfaces of the cams. A slot which provides access to the surfaces are fabricated in the housing. To insert the module in the shelf channel, the cams are latched in the home position and inserted into the channel which unlatches the cams. The cams secure the label as previously described.

A module removal tool having a head section and an elongated notched section is provided. When the elongated section is inserted in the slot, the notches engage the vein-like protrusions when inserted. Extraction of the tool rotates the cams back to the home position whereat the module can be easily removed from the shelf channel.

The foregoing and other objects and advantages of this invention will be more fully described in the accompanying drawings.

DETAILED DESCRIPTION OF THE PREFERRED EMBODIMENT

Figure 1:
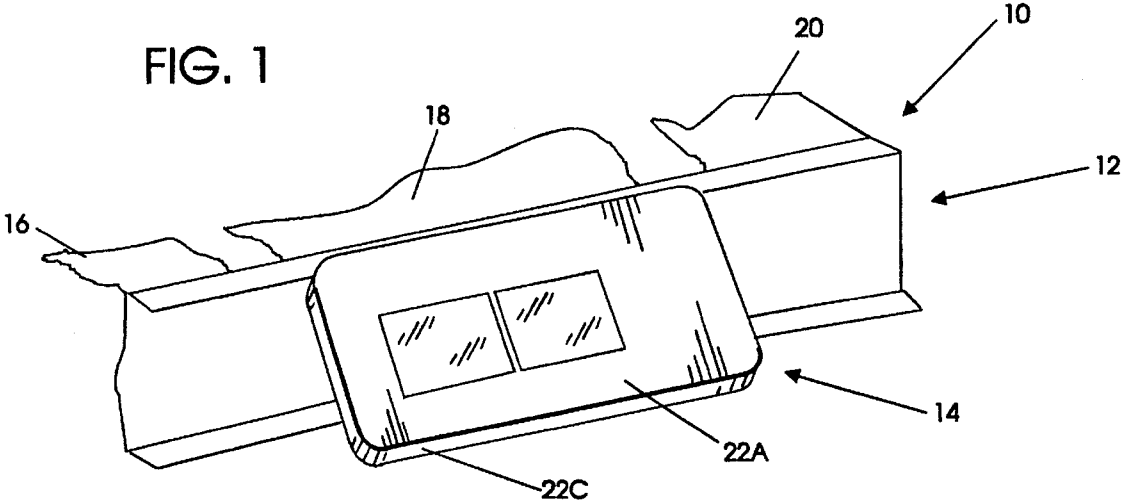
FIG. 1 shows a partial perspective view of the product information module mounted in the shelf label channel of a shelf.

FIG. 1 shows a partial perspective view of a display and labeling system which can be used in a retail establishment to display products and product information to customers. The display and labeling system includes a shelf 10 on which distinct stacks of items schematically identified by numerals 16, 18 and 20 are mounted. The shelf 10 is provided with a shelf channel 12 in which information assembly, one of which is shown by numeral 14 are mounted to provide information to shoppers regarding the pile of items under which it is mounted. Usually, the information assembly 14 identifies the product pile by name, cost per item, etc. To this end, the information assembly 14 includes an information module 22 and a latching mechanism 24 (FIG. 2).

Figure 2:
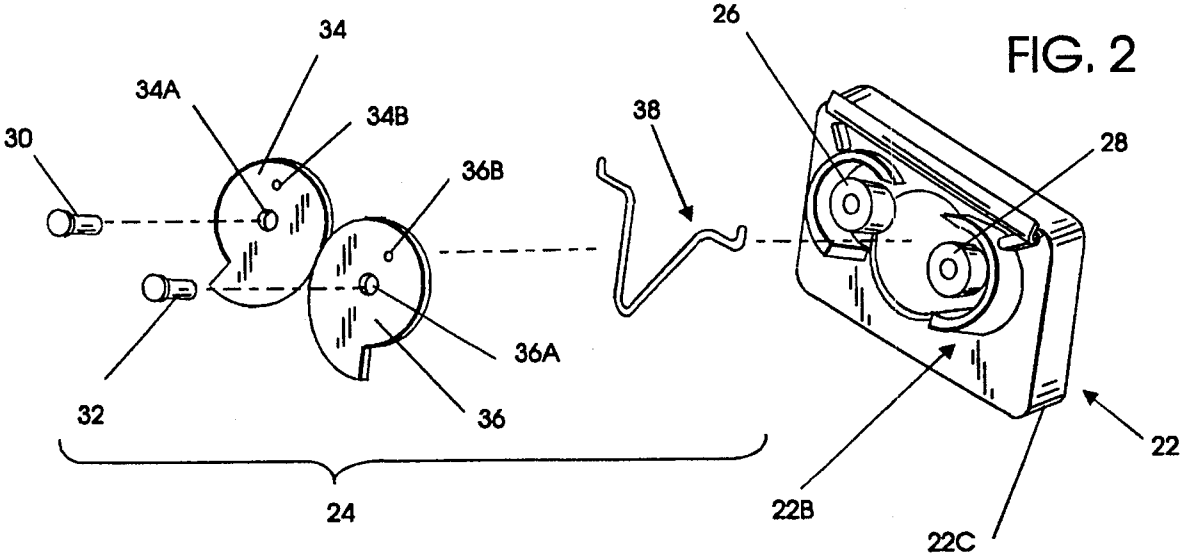
FIG. 2 shows the rear surface of the module and the disassembled components of the locking mechanism which mounts the module to the shelf label channel.

Referring to FIGS. 1 and 2, the information module 22 is substantially flat with a first surface 22A with windows displaying information such as product name, pricing, etc., to the shopper. An opposite surface, such as 22B, supports the latching mechanism 24 which attaches the information module in the shelf channel 12. The mechanism for providing the display on face 22 can be as elaborate as an electronic module which is mounted in the housing and changes automatically from information downloaded from the controller of a point of sale system (not shown). Such electronic modules are well known in the prior art including U.S. Pat. Nos. 4,821,291 and 4,654,514. Therefore, further discussion will not be given. Alternatively, the information in the display window can be written or typed on a sheet of paper and placed in or around the display window.

Turning to FIG. 2 for the moment, a pair of hub members 26 and 28 are fabricated on surface 22B of housing 22C. Preferably, the hub members 26 and 28 are on the surface opposite to display surface 22A. The latching mechanism 24 includes rivets 30 and 32, cams 34 and 36 and spring 38. Each cam is fabricated with a desired cam profile on its periphery, a central hole 34A or 36A for mounting and radial holes 34B and 36B.

Figure 3:
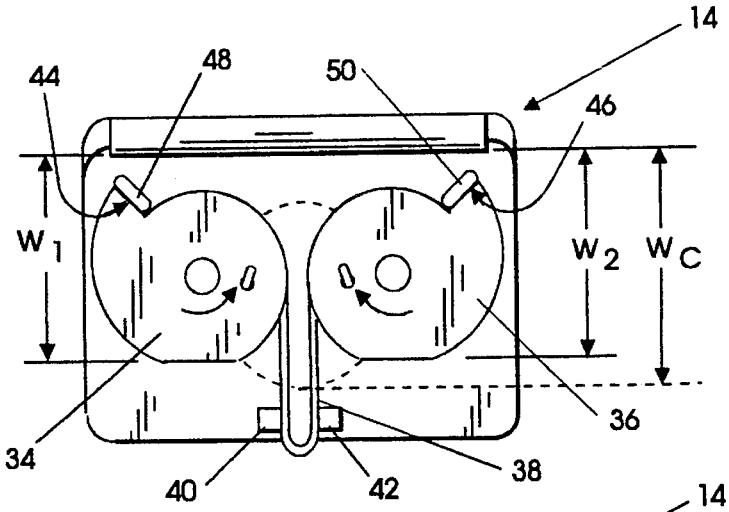
FIG. 3 shows the assembled locking mechanism with the cams in the under center position.
Figure 4:
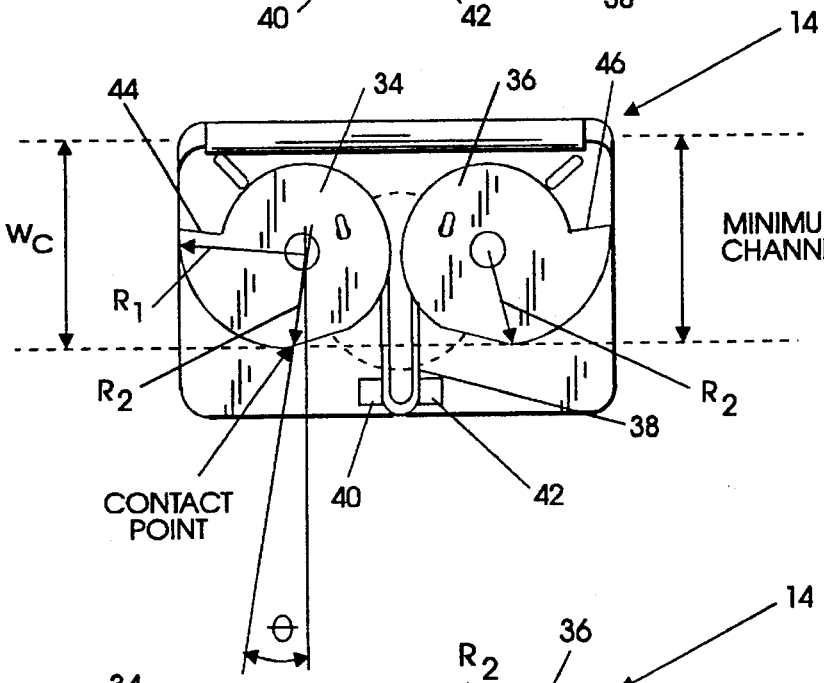
FIG. 4 shows the cams in the locking position of a minimum width channel.
Figure 5:
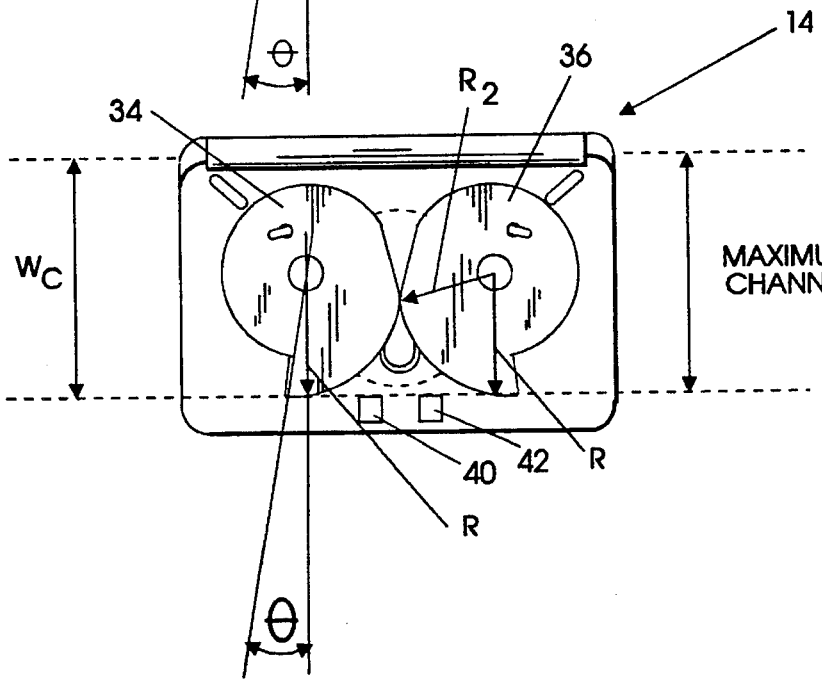
FIG. 5 shows the cams in the locking position of a maximum width channel.

FIGS. 3, 4 and 5 show the rear surface (22B) of information assembly 14 with the latching mechanism 24 in assembled form. Throughout the drawings, common elements are marked with the same numeral. To assemble the latching mechanism, the cams 34 and 36 are rotatably mounted by rivets 30 and 32 to hub members 26 and 28, respectively. The free ends of spring 38 are connected to radial holes 34B and 36B, respectively. A pair of members 40, 42 are fabricated in spaced relation on the rear surface of the information module and define a channel through which a looped section of spring 38 extends as is shown in FIG. 3. This extension creates a torque on the cams 34 and 36 and causes them to rotate in the opposite direction shown by the respective arrows until surfaces 44 and 46 on each cam rest against stop members 48 and 50, respectively. In this orientation, shown in FIG. 3, the cams are in the under center condition or position. In this position, the widths W1 and W2 of cams 34 and 36, respectively, measure in a direction perpendicular to the lengthwise dimension of the shelf channel is less than the width wc across the channel. As a consequence, the information assembly can be easily mounted in the shelf channel.

Still referring to FIGS. 4 and 5, the information assembly 14 mounted in a minimum channel width is shown in FIG. 4 and in a maximum channel width is shown in FIG. 5. Due to the self-adjustment characteristics of the mounting assembly, the information assembly can be fitted in any size channel without damaging the channel or requiring special mounting assembly, as was required in the prior art. In FIG. 4, the information assembly is shown in its latched position with the surfaces of cam 34 and 36 against the lower edge of the minimum shelf channel. To be in this latched position, the spring 38 is pushed upwardly, causing the cam members 34 and 36 to rotate in opposite directions until the cam surfaces are brought into contact with the edge of the shelf channel. The optimum locking condition occurs when the tangent of angle θ is less than the coefficient frictional forces between the periphery of the cam and the surface of the shelf channel.

FIG. 5 shows the orientation of the cams relative to the shelf channel when the channel has a maximum channel width. In that position, the cams with maximum radii R are in contact with the surface of the shelf channel. It should be noted that the angle of contact, θ, is maintained for any channel from minimum to maximum width.

Referring to FIGS. 3, 4 and 5, the cams are rotatably secured to the back of the information module 22 by rivets 30 and 32 (FIG. 2). Preferably, the cams are fabricated from sheet metal having thickness within the range of 0.02 to 0.04 inches. The cams are designed to fit a wide range of shelf channel widths, with the range of self-channel widths being (R1–R2) where R1 is the larger radius of each cam and R2 is the smaller radius (FIG. 4 and 5). Therefore, as the cams rotate, they automatically adjust to fit the shelf-channel in which they are placed. At installation, the spring is in the downward position (FIG. 3) which is maintained because of the under center condition of the cam position. As a consequence, the cams are forced against their respective stops 48, 50 and the information module sometimes called shelf label is inserted into the shelf edge channel. The label is held in position and the spring is manually pushed upwards by the installer. The spring moves upward to the over center position and the cams rotate until stopped by shelf edge channel. The label is now secured in the channel (FIGS. 4 and 5).

Moving the module along the channel is prevented by the cam profile. Lateral motion in either direction causes the cams to rotate against the channel as long as the tangent of angle is less than the coefficient of friction between the cam and the channel. Angle θ is referred to as the angle of repose. This condition ensures that the cams will not slide in the channels. The cam profile is designed to maintain θ for any channel width between the maximum and minimum specified. One cam would tend to roll away from the channel and would easily move, but the other cam rotates into the channel causing the normal force to increase along with its friction force. This action prevents lateral motion of the label since the cam profiles oppose each other, motion in either direction is resisted.

Figure 7:
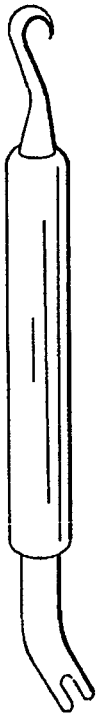
FIG. 7 shows a removal tool for use with the embodiment of the invention.

The module is removed from the shelf edge channel by inserting a tool, such as a simple spring-hook type (FIG. 7), from the bottom of the module. The tool is comprised of an essentially cylinderical length of metal with a reduced section at the ends at least one of which is formed into a hook. Spring-hooks are a common tool used to service business machines. The spring-hook engages the center of the spring and forces it downward. This action rotates each cam away from the channel and into the original under center position and allows the label to be easily removed from the shelf edge channel. The tool provides an element of security against unauthorized removal of the labels.

Figure 6A:
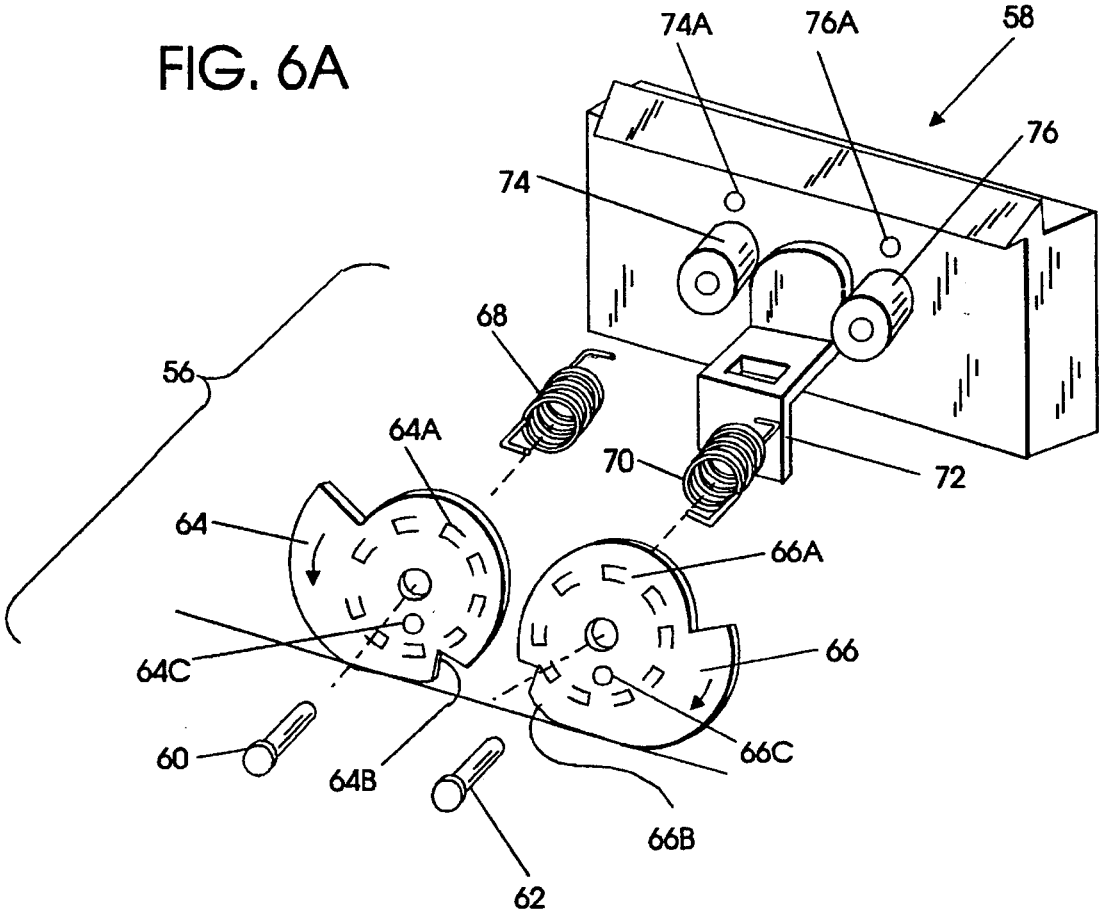
FIGS. 6A and 6B show an alternate embodiment of locking mechanism and a removal tool.

FIG. 6A shows an exploded view for an alternative embodiment of the information assembly according to the teachings of the present invention. The information assembly includes a latching mechanism 56 which is mounted to the back of information module 58. The front of information module 58 provides the information to the shopper. The latching mechanism 56 includes rivets 60, 62, a pair of cams 64, 66 and springs 68 and 70. Each cam has on its flat surface a plurality of radial lances 64A and 66A and holes 64C and 66C. Notches 64B and 66B are formed into the edges of the cams. The notches coact with cam latch/battery cover 72 to hold the cams in their home position ready to be inserted into the shelf edge channel. As will be explained below, the cams are positioned into the shelf channel and are freed to rotate in the direction shown by the arrows when the cam latch/battery cover is forced from between the notches by the lower channel edge. The information assembly is mounted in the shelf channel in a manner similar to the one previously described.

Figure 6B:
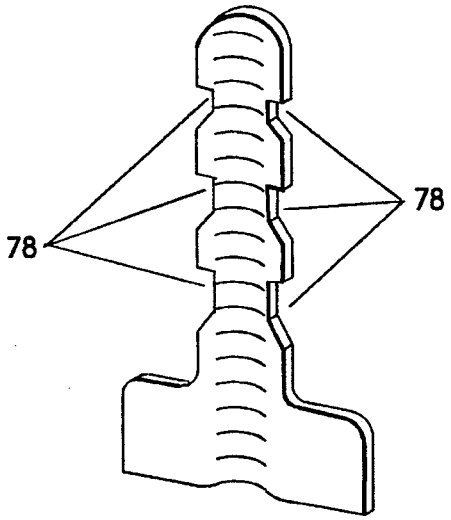

Still referring to FIGS. 6A and 6B, to assemble the latching mechanism 56, springs 68 and 70 are mounted over hub members 74 and 76, respectively. Rivets 60 and 62 attach the cams 64 and 66 to each one of the hub members so that the springs 68 and 70 coact with holes 74A, 76A, 64C and 66C to provide a torque to each cam in the direction of the arrows shown. The notches 64B and 66B rest against cam latch/battery cover 72 so that the spring torque is resisted positioning the cams and the information assembly (information module and locking mechanism) can be inserted easily within the previously described shelf channel. At insertion into the shelf channel, the top edge of the label is inserted into the top groove of the channel first and the label is rotated downward so that the bottom of the channel forces cam latch/battery cover 72 from notches 64B and 66B causing the cams to rotate in the directions of the arrows and engage the shelf channel. As before, the cam rotates in opposite direction until they are in contact with the surface of the channel so as to lock the information module in the channel. To remove the information assembly from the channel, the key 78 shown in FIG. 6B is inserted and the coaction between the radial lances and the notches in the key as the key is pulled downward in a direction opposite the arrows shown causes the cam to rotate and lift from the surface of the channel. Thereafter, the information assembly is easily removed from the channel.

While the invention has been particularly shown and described with reference to the preferred embodiment thereof, it will be understood by those skilled in the art that various changes in form and details may be made therein without departing from the spirit and scope of the invention.

What is claimed is:

1. An assembly for attaching an information module to a channel of a support surface comprising:

a first means for contacting a surface of said channel and securely locking thereto;

a second means for pivotally securing the first means to the information module; and a positioning means connected to the first means; said positioning means, if placed in a first position, applies a torque which causes said first means to be held in a first position with a width across one dimension of said first means being less than a predetermined value and if said positioning means is placed in a second position, causes said first means to translate from the first position to a second position whereat Said first means is placed in a locking state with the width across said one dimension being greater than the predetermined value.

2. The assembly of claim 1 wherein the first means includes a pair of cams with each cam having a central mounting hole and a radial hole.

3. The assembly of claim 2 with each cam having a camming surface displaced at distances R1 and R2 from the central mounting hole with R1 greater than R2 and R1–R2 being equivalent to the difference in widths of different channels in which the informational module is to be mounted.

4. The assembly of claim 2 wherein the material from which the cams are fabricated includes sheet metal.

5. The assembly of claim 1 wherein the second means includes two rivets.

6. The assembly of claim 1 wherein the positioning means include a looped wire spring.

7. The display and information system of claim 1 wherein the tangent of an angle formed between the cam and the surface is less than the coefficient of friction therebetween.

8. The assembly of claim 1 wherein the predetermined value includes a width across the channel.

9. An information device for mounting on a shelf channel to provide shoppers with product information comprising:

a housing;

a module for displaying product information mounted in said housing;

a pair of cams rotatably mounted in spaced relation to one surface of the housing; and a positioning means coupled to the pair of cams; said positioning means applying torque to keep the pair of cams in an under-center position relative to a reference surface on each one of said pair of cams and being responsive to a force applied in a first direction to rotate the pair of cams until the cams are brought into non-slidable relation with the shelf channel.

10. The information device of claim 9 wherein the force is applied in a second direction causing the cams to rotate and lift from the channel so that the information device can be removed from said channel.

11. The information device of claim 10 wherein the second direction is opposite to the first direction.

12. The information device of claim 9 wherein the cams are rotated in opposite direction.

13. The information device of claim 9 wherein the positioning means includes a looped wire spring with each free end of the looped wire spring connected to one of the pair of cams.

14. The information device of claim 9 wherein each cam is provided with vane-like members protruding from one surface, a hole and at least one notch on its periphery; and said positioning means includes cam latch means for coacting with the at least one notch on each cam to place said each cam in a predetermined position; and a pair of coil springs one of each mounted between each one of the cams and the housing and coacting with the hole on each cam to apply a torque which hold the cams in the predetermined position.

15. The information device of claim 14 wherein each cam is released by the action of inserting the information device into the shelf channel which forces the cam latch means from the notches and causes the cams to rotate and latch onto the shelf channel.

16. The information device of claim 14 further including a tool with notches thereon; said tool when brought in contact with the vane-like members causes the cams to rotate lift from the shelf channel.

17. The information device in claim 9 further including a pair of stop members mounted on said housing wherein a reference surface on each one of said pair of cams is brought into contact with one of the pair of stop members when said pair of cams are in the under-center position.

18. A display and information system comprising:

a shelf with at least one surface supporting articles for sale and at least one shelf channel in a distal end;

a housing;

a means for displaying product information mounted in said housing;

a device mounted to the housing and operable for locking the housing onto the shelf channel, said device including at least one cam rotatably mounted to the housing and having a periphery displaced at distances R1 and R2 from a center point on said at least one cam wherein R1 is greater than R2 and R1–R2 having a value equivalent to a desired range of shelf channel widths in which the device is to be mounted; and a positioning means connected to the at least one cam and operable to set the cam into a first position whereat the housing is easily inserted in the at least one shelf channel and responsive to an applied force to cause the at least one cam to be brought into contact with a surface of said at least one shelf channel to lock the housing in the at least one shelf channel.

* * * * *